US009528069B2

(12) United States Patent
Price et al.

(10) Patent No.: US 9,528,069 B2
(45) Date of Patent: Dec. 27, 2016

(54) LUBRICANT AND FUNCTIONAL FLUID COMPOSITIONS CONTAINING VISCOSITY INDEX IMPROVER

(75) Inventors: David Price, Littleover (GB); William R. S. Barton, Derby (GB)

(73) Assignee: The Lubrizol Corporation, Wickliffe, OH (US)

( * ) Notice: Subject to any disclaimer, the term of this patent is extended or adjusted under 35 U.S.C. 154(b) by 317 days.

(21) Appl. No.: 13/978,604

(22) PCT Filed: Jan. 9, 2012

(86) PCT No.: PCT/US2012/020584
§ 371 (c)(1),
(2), (4) Date: Oct. 22, 2013

(87) PCT Pub. No.: WO2012/096864
PCT Pub. Date: Jul. 19, 2012

(65) Prior Publication Data

US 2014/0031269 A1 Jan. 30, 2014

Related U.S. Application Data

(60) Provisional application No. 61/431,213, filed on Jan. 10, 2011.

(51) Int. Cl.

| | |
|---|---|
| ***C10L 1/22*** | (2006.01) |
| ***C10L 1/18*** | (2006.01) |
| ***C10M 151/02*** | (2006.01) |
| ***C10M 149/00*** | (2006.01) |
| ***C10M 151/00*** | (2006.01) |
| ***C10M 161/00*** | (2006.01) |
| ***C10M 165/00*** | (2006.01) |
| ***C10M 167/00*** | (2006.01) |

(52) U.S. Cl.
CPC ..... *C10M 151/02* (2013.01); *C10M 149/00* (2013.01); *C10M 151/00* (2013.01); *C10M 161/00* (2013.01); *C10M 165/00* (2013.01); *C10M 167/00* (2013.01); *C10N 2220/021* (2013.01); *C10N 2220/029* (2013.01); *C10N 2230/02* (2013.01); *C10N 2240/04* (2013.01); *C10N 2240/042* (2013.01); *C10N 2240/044* (2013.01); *C10N 2240/046* (2013.01); *C10N 2240/10* (2013.01); *C10N 2260/02* (2013.01); *C10N 2260/04* (2013.01); *C10N 2270/00* (2013.01)

(58) Field of Classification Search
CPC .. C10M 143/12; C10M 143/10; C10M 143/14
USPC ..... 508/241, 306
See application file for complete search history.

(56) References Cited

U.S. PATENT DOCUMENTS

| | | | | |
|---|---|---|---|---|
| 5,955,405 | A * | 9/1999 | Liesen | C08F 220/18 252/79 |
| 2003/0055179 | A1* | 3/2003 | Ota et al. | 525/242 |
| 2008/0026962 | A1* | 1/2008 | Poirier | 508/154 |
| 2009/0005274 | A1* | 1/2009 | Swartele et al. | 508/110 |

OTHER PUBLICATIONS

Johnson, Russell: "Self-healing polymers prolong oil lifetime", "Highlights in Chemical Science", vol. 7 No. 2, age Feb. 5, 2010.
Syrett, Jay A. et al., "Self-healing polymers prepared via living radical polymerisation", "Polymer Chemistry", vol. 1, No. 1, Jan. 15, 2010.
Syrett, Jay A. et al., "Self-healing and self-mendable polymers", "Polymer Chemistry", vol. 1, No. 7, May 13, 2010.
Kamada, Jun et al., "Redox Responsive Behavior of Thiol/Disulfide-Functionalize Star Polymers Synthesized via Atom Transfer Radical Polymerization", "Macromolecules", vol. 43, No. 9, Apr. 15, 2010.
University of Warwick, "Self-healing polymer 'starfish' prolong lifetime of automotive oils", "Science Daily", Jan. 29, 2010 (retrieved Oct. 1, 2010).
Gill, George, "Starfish' Polymer Has Lube Benefits", "Lube Report", vol. 10 issue 9, Mar. 3, 2010.
Lubrizol 2009 Annual Report, p. 7, 2009. The image shows some chemical structures drawn on a board and the words "Self-healing polymers?".
Corresponding International Publication No. WO 2012/096864 A1 published Jul. 19, 2012.
Written Opinion from corresponding International Application No. PCT/US2012/020584 dated May 4, 2012.
Search Report from corresponding International Application No. PCT/US2012/020584 dated May 4, 2012.

* cited by examiner

*Primary Examiner* — Prem C Singh
*Assistant Examiner* — Francis C Campanell
(74) *Attorney, Agent, or Firm* — David M. Shold, Esq.; Teresan W. Gilbert, Esq.

(57) ABSTRACT

The disclosed invention relates to lubricant or functional fluid compositions containing viscosity index improvers in the form of self-healing polymers. The polymers may comprise one or more cleavable linkages, such as one or more disulfide bonds and/or one or more diene/dienophile linkages, to permit the polymer to reform if cleaved during use.

17 Claims, No Drawings

LUBRICANT AND FUNCTIONAL FLUID COMPOSITIONS CONTAINING VISCOSITY INDEX IMPROVER

TECHNICAL FIELD

This invention relates to lubricant and functional fluid compositions containing viscosity index (VI) improvers. More particularly, this invention relates to lubricant and functional fluid compositions containing VI improvers in the form of self-healing polymers.

BACKGROUND

Petroleum products typically exhibit large variations in viscosity with variations in temperature. However, for lubricating oil compositions and functional fluid compositions, it is preferable that the temperature dependence of the viscosity be small. In order to decrease the temperature dependence of viscosity, VI improvers have been added to lubricating oils and functional fluids. VI improvers may be referred to as viscosity modifiers.

SUMMARY

Film thickness is a measure of the ability of a lubricant or functional fluid to protect moving parts under hydrodynamic and elastohydrodynamic lubrication conditions. Film thickness (and thus fluid film protection) is proportional to viscosity. The viscosity and VI contribution to a lubricant or functional fluid from a VI improver is generally proportional to the molecular weight of the VI improver for a given polymer. A high molecular weight VI improver will typically provide a higher increase in viscosity and VI on a per weight basis than a VI improver of the same polymer at a lower molecular weight. However, a problem with higher molecular polymers is that they tend to undergo higher levels of permanent shear loss during operation as compared to lower molecular polymers. This leads to a reduction in viscosity and VI functionality and thus limits their use in applications where film protection is vital. This invention provides a solution to this problem by employing as a VI improver a relatively high molecular weight self-healing polymer which can be reformed during use if it is cleaved or would otherwise be permanently sheared.

This invention relates to a lubricant or functional fluid composition, comprising: an oil of lubricating viscosity; and a viscosity index improving amount of a self-healing polymer, the self-healing polymer comprising one or more linkages which permit the polymer to reform if cleaved during use. The linkages may comprise one or more disulfide bonds and/or one or more diene/dienophile linkages. These linkages may be referred to as cleavable linkages or leavable linkers. The diene/dienophile linkage may be referred to as a Diels-Alder (DA) linkage.

The self-healing polymer may be a linear or a branched polymer, a hyper-branched polymer or a star polymer. The term "hyper-branched" is used herein to refer to a branched polymer wherein the branches of the polymer are branched. The hyper-branched polymer may be referred to as a dendritic or highly branched polymer. The self-healing polymer may be characterized by one or more cleavable linkages, such as one or more disulfide bonds and/or one or more diene/dienophile linkages, located at one or more points along the backbone of the polymer when the polymer is a linear or branched polymer; or in the backbone, or in branches, or at one or more branching points when the polymer is hyper-branched; or in the core or one or more arms of the polymer when the polymer is a star polymer. The cleavable linkage may be cleaved during operation, and reformed in situ.

DETAILED DESCRIPTION

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The term "self-healing polymer" refers to a polymer that may degrade over time as a result of stresses and strains but has the capability of reforming by auto-response or in response to external stimuli. Polymer self-healing may occur in the absence of metal catalysts or in the presence of metal catalysts. Appropriate metal catalysts may be combined with the polymer for incorporation into the lubricating composition or functional fluid. Metals arising from the operation of a mechanical device (e.g. iron, copper, and the like) via wear or other mechanisms may catalyze polymer self-healing. In one embodiment, the lubricant composition or functional fluid containing the self-healing polymer is free of or essentially free of added metal catalysts. In one embodiment, the lubricant composition or functional fluid containing the self-healing polymer further comprises one or more oil soluble metal compounds that may catalyze polymer healing.

The terms "hydrocarbyl" and "hydrocarbon," when referring to groups attached to the remainder of a molecule, refer to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, amino, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbyl or hydrocarbon group.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about 0.5 gram per liter at 25° C.

The term "TBN" refers to total base number. This is the amount of acid (perchloric or hydrochloric) needed to neutralize all or part of a material's basicity, expressed as milligrams of KOH per gram of sample.

The term "TAN" refers to total acid number. This is the amount of base (NaOH or KOH) needed to neutralize all or part of a material's acidity, expressed as milligrams of KOH per gram of sample.

The Lubricant or Functional Fluid Composition

The lubricant or functional fluid composition may comprise an engine oil, an automatic transmission fluid (ATF), traction fluid, fluid for a continuously variable transmission (CVT), dual clutch automatic transmission fluid, farm tractor fluid, manual transmission fluid, fluids for a hybrid vehicle transmission, gear oil, engine lubricant, and the like.

The lubricant or functional fluid composition may comprise one or more base oils which may be present in a major amount. The base oil may be present in an amount greater than about 60% by weight, or greater than about 70%, or greater than about 75% by weight of the lubricant composition.

The lubricant or functional fluid composition may have a viscosity of up to about 32.5 cSt at 100° C., or from about 4.5 to about 32.5 cSt at 100° C., or from about 5.3 to about 18.5 cSt at 100° C., or from about 6 to about 13.5 cSt at 100° C.

The lubricant or functional fluid composition may have an SAE Viscosity Grade of OW-20, OW-30, OW-40, OW-50, OW-60, 5W-20, 5W-30, 5W-40, 5W-50, 5W-60, 10W-20, 10W-30, 10W-40, 10W-50, 15W-20, 15W-30, 15W-40, 15W-50 or 15W-60.

Oil of Lubricating Viscosity

The oil of lubricating viscosity may be referred to as a base oil. The base oil may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAO) | | | |
| Group V | All others not included in Groups I, II, III, or IV | | | |

The base oil may contain less than about 300 ppm sulfur and/or at least about 90% saturate content, determined by test procedure described in ASTM D2007. The base oil may have a viscosity index of at least about 95, or at least about 115. The base oil may have a viscosity index of at least about 120, and comprise one or more polyalphaolefins. The base oil may have a viscosity index of up to about 130.

Groups I, II and III are mineral oil base stocks. The base oil may comprise natural or synthetic lubricating oils and mixtures thereof. Mixture of mineral oil and synthetic oils, particularly polyalphaolefin oils and ester oils, may be used.

Natural oils may include animal oils and vegetable oils (e.g. castor oil, lard oil, and other vegetable acid esters) as well as mineral lubricating oils such as liquid petroleum oils and solvent-treated or acid treated mineral lubricating oils of the paraffinic, naphthenic, or mixed paraffinic-naphthenic types. Hydrotreated or hydrocracked oils may be included within the scope of useful oils.

Base oils derived from coal or shale may be useful. Synthetic lubricating oils may include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, may constitute other classes of known synthetic lubricating oils that can be used. Another suitable class of synthetic lubricating oils that may be used comprises the esters of dicarboxylic acids and those made from about $C_5$ to about $C_{12}$ monocarboxylic acids and polyols or polyol ethers.

Other suitable synthetic lubricating oils may include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils may be used. Synthetic oils may be used, such as those produced by Fischer-Tropsch reactions and typically may be hydroisomerized Fischer-Tropsch hydrocarbons or waxes. The base oil may be prepared by a Fischer-Tropsch gas-to-liquid synthetic procedure as well as other gas-to-liquid procedures.

Unrefined, refined and rerefined oils, either natural or synthetic (as well as mixtures of two or more of any of these) of the type disclosed hereinabove may be used. Unrefined oils are those obtained directly from a natural or synthetic source without further purification treatment. Refined oils are similar to the unrefined oils except they have been further treated in one or more purification steps to improve one or more properties. Rerefined oils may be obtained by processes similar to those used to obtain refined oils applied to refined oils which have been already used in service. The rerefined oils often are additionally processed by techniques directed to removal of spent additives and oil breakdown products.

The amount of oil in a fully formulated lubricant will typically be the amount remaining to equal 100 percent after the remaining additives are accounted for. Typically this may be from about 60 to about 99 percent by weight, or from about 70 to about 97 percent, or from about 80 to about 95 percent, or from about 85 to about 93 percent by weight. The lubricant composition may be delivered as a concentrate, in which case the amount of oil is typically reduced and the concentrations of the other components are correspondingly increased. In such cases the amount of oil may be from about 30 to about 70 percent by weight, or from about 40 to about 60 percent by weight.

Self-Healing Polymer

The lubricant or functional fluid composition contains a viscosity index improving amount of one or more self-healing polymers. These polymers may be referred to as VI improvers. The self-healing polymer may comprise one or more cleavable linkages, such as one or more disulfide bonds and/or one or more diene/dienophile linkages. These linkages may be used to permit the polymer to reform if cleaved during use. The polymer may be a star polymer, a linear or branched polymer, or a hyper-branched polymer. The disulfide and diene/dienophile bonds are illustrated in FIGS. 1 and 2 shown below. A disulfide bond, or sulfur-sulfur bond, may be reformed by oxidation of the corresponding thiol. The disulfide bonds may be reduced to the corresponding thiol, with, for example a trialkyl phosphite to yield two or more lower molecular weight polymer chain fragments. Conversely, the two or more thiol polymer chain fragments may be reoxidized to a larger disulfide linked polymer under oxidative conditions in the presence of, for example, transition metals (e.g., iron, copper, and the like) which may be present in the lubricant or functional fluid as wear debris. The diene/dienophile linkages may undergo a Diels-Alder reaction following external stress or strain induced retro Diels-Alder. In the schemes shown below, the polymers are denoted by the R groups. The diene/dienophile may be substituted to provide for one or more polymeric arms on the diene as well as the dienophile. Multiple disulfide and/or diene/dienophile linkages or functionalities may be incorporated at the core for star polymers; or at one or more points on a backbone of linear or branched polymers; or in the backbone, in branches or at branching points for hyper-branched polymers. The dienes may include aromatic and polyaromatic compounds. These may include furan and anthracene derivatives.

The following FIG. 1 shows the cleavage and reformation of a star polymer with a disulfide bond:

FIG. 1

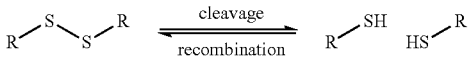

The following FIG. 2 shows the cleavage and reformation of a polymer with a diene/dienophile linkage:

FIG. 2

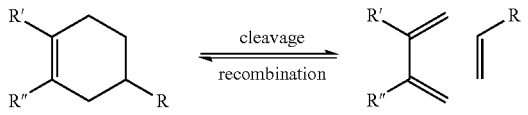

The self-healing polymer may comprise any relatively high molecular weight VI improver provided the VI improver has been modified to contain one or more cleavable linkages such as disulfide bonds and/or one or more diene/dienophile linkages to permit the polymer to reform if it is cleaved during use. The VI improvers that may be so modified may include one or more hydrogenated styrene-butadiene rubbers, olefin copolymers such as ethylene-propylene copolymers, polymethacrylates, polyacrylates, hydrogenated styrene-isoprene polymers, hydrogenated diene polymers, poly(alkyl styrenes), polyolefins such as polyisobutylene, esters of maleic anhydride-olefin copolymers (such as those described in International Application WO 2010/014655), esters of maleic anhydride-styrene copolymers, or mixtures of two or more thereof.

The self-healing polymer may comprise a dispersant viscosity modifier which may be any relatively high molecular dispersant viscosity modifier provided the dispersant viscosity modifier has been modified to contain one or more cleavable linkages such as one or more disulfide bonds and/or diene/dienophile linkages to permit the polymer to reform if it is cleaved during use. The dispersant viscosity modifier that may be so modified may include one or more ethylene-propylene copolymers that have been functionalized with an acylating agent such as maleic anhydride and an amine; polymethacrylates functionalized with an amine; and/or styrene-maleic anhydride copolymers reacted with an amine. More detailed descriptions of dispersant viscosity modifiers that may be modified are disclosed in International Publication WO2006/015130 or U.S. Pat. Nos. 4,863,623; 6,107,257; 6,107,258; and 6,117,825. The dispersant viscosity modifier that may be modified may include those described in U.S. Pat. No. 4,863,623 (see column 2, line 15 to column 3, line 52) or in International Publication WO2006/015130 (see page 2, paragraph [0008] and preparative examples described in paragraphs [0065] to [0073]).

The foregoing polymers may be modified by incorporating a cleavable linker as part of the head group of polymerization, particularly as a result of living free radical polymerization. The linker may be incorporated in a polymer to provide a branched architecture, or incorporated as a cleaved entity and allowed to combine under given reaction conditions.

The self-healing polymer may comprise one or more poly(meth)acrylates, provided the poly(meth)acrylate includes one or more cleavable linkages such as one or more disulfide bonds and/or one or more diene/dienophile linkages. The expression "(meth)acrylate" is used herein to refer to acrylate, methacrylate, or a mixture thereof. The poly (meth)acrylates may include the corresponding poly(meth) acrylic acids, poly(meth)acrylic acid amides, mixtures thereof, and the like, which include one or more of the above-indicated cleavable linkages. The poly(meth)acrylate (or corresponding acid, amide, and the like) may comprise form about 15 to about 90 wt %, or from about 50 to about 85 wt %, monomer units derived from $C_{12}$ to $C_{18}$ alkyl (meth)acrylate monomer units, or $C_{12}$ to $C_{15}$ alkyl(meth) acrylate monomers; from about 0.1 to about 25 wt % monomer units derived from $C_1$ to $C_{1-}$ alkyl(meth)acrylate monomer units; and from 0 to about 10 wt %, or from about 0.1 to about 5 wt %, monomer units derived from one or more dispersant monomers. The meth(acrylate) monomers that may be used may include methyl methacrylate, butyl methacrylate, 2-ethylhexyl methacrylate, $C_{12}$-$C_{15}$ alkyl methacrylate, $C_{16}$-$C_{18}$ alkyl methacrylate, mixtures of two or more thereof, and the like. The alkyl groups may be linear or branched, and saturated or unsaturated. In one embodiment, the alkyl groups are linear and saturated. Other monomer units that may copolymerize with (meth)acrylate monomers may be present.

The self-healing polymer may contain from 0 to about 10 wt % monomer units of one or more dispersant monomers. These may comprise one or more nitrogen-containing monomers. These monomers may be of the type used to impart dispersant characteristics to the polymer. The resulting polymer may be referred to as a dispersant viscosity modifier. The nitrogen-containing monomers may comprise one or more (meth)acrylic monomers, for example, one or more methacrylates or methacrylamides. The linkage of the nitrogen-containing moiety to the acrylic moiety may be through a nitrogen atom or through an oxygen atom, in which case the nitrogen of the monomer may be located elsewhere in the monomer unit. The nitrogen-containing monomer may comprise one or more vinyl-substituted nitrogen heterocyclic monomers, vinyl substituted amines, and the like. The nitrogen-containing monomers may include those disclosed in U.S. Pat. No. 6,331,603. The monomers may include one or more dialkylaminoalkyl acrylates, dialkylaminoalkyl methacrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to about 8 carbon atoms. The nitrogen-containing monomer may comprise t-butyl acrylamide, N-(3-(dimethylamino)-propyl)-meth-acrylamide, dimethylaminopropyl methacrylamide, dimethylaminoethyl methacrylamide, N-vinyl pyrrolidone, N-vinylimidazole, N-vinyl caprolactam. The nitrogen-containing monomer may comprise one or more of the (meth) acrylamide or vinyl monomers mentioned above or the nitrogen may be incorporated by reaction of amines with a carboxylated polymer, such as the aromatic amines disclosed in WO2005/087821 including 4-phenylazoaniline, 4-amino-diphenyl-amine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl) benzamide, N-(4-amino-phenyl)benzamide, 4-amino-2-hydroxy-benzoic acid phenyl ester, and N,N-dimethyl-phenylenediamine and in a manner similar to that disclosed in WO 2005/087821.

The dispersant monomer may comprise one or more monomers containing a pendent hydrocarbyl group substituted with a nitrogen- or oxygen-containing group, such as an amino group or a hydroxy group. Examples of dispersant monomers with an oxygen-containing group that may be used may include one or more hydroxyalkyl(meth)acrylates such as hydroxyethyl methacrylate.

The self-healing polymer may have a number average molecular weight (as determined by gel permeation chromatography (GPC) using polystyrene as the calibration standard) in the range from about 5000 to about 1,000,000, or from about 10,000 to about 500,000, or from about 5000 to about 100,000, or from about 100,000 to about 1,000,000. The molecular weight distribution, Mw/Mn, (as determined by GPC using polystyrene as the calibration standard, where Mw is the weight average molecular weight, and Mn is the number average molecular weight) of the polymer may be in the range from about 1.1 to about 8, or in the range from about 1.1 to about 2.5, or from about 2 to about 6.

The self-healing polymer may be present on a weight basis in the lubricant or functional fluid composition in the range from about 0.1 wt % to about 35 wt %, or in the range from about 0.5 wt % to about 20 wt %, or from about 0.5 wt % to about 5 wt %, or from about 15 wt % to about 35 wt %, or from about 20 wt % to about 35 wt %.

The self-healing polymer may be supplied in neat form (i.e., without diluent) or concentrate form. The concentrate may include a diluent oil and from about 5 wt % to about 99 wt % of the VI improver, or from about 5 wt % to about 85 wt % of the VI improver. One or more of the above-identified additives may also be included in the concentrate.

Example 1

The disulfide polymer is reduced using $Bu_3P$ (where Bu is butyl) in dimethylformamide (DMF) at 40° C. to cleave the polymer at the —S—S— bond, and then oxidized using $FeCl_3$ to reform the polymer. The polymer initially has a Mn of 9300 g/mol. After one hour the polymer is cleaved (Mn 6000 g/mol). Over eight hours, the polymer reforms to yield a polymer with a Mn of 8900 g/mol. Mn is determined using gel permeation chromatography (GPC) and NMR.

Example 2

The Diels-Alder (DA) adduct shown in FIG. 3 is used as a polymer initiator in atom transfer radical polymerization (ATRP). Following polymerization of the initiator, the adduct is cleaved and reformed as described below.

FIG. 3: Synthesis of Diels-Alder (DA) initiator for controlled radical polymerization.

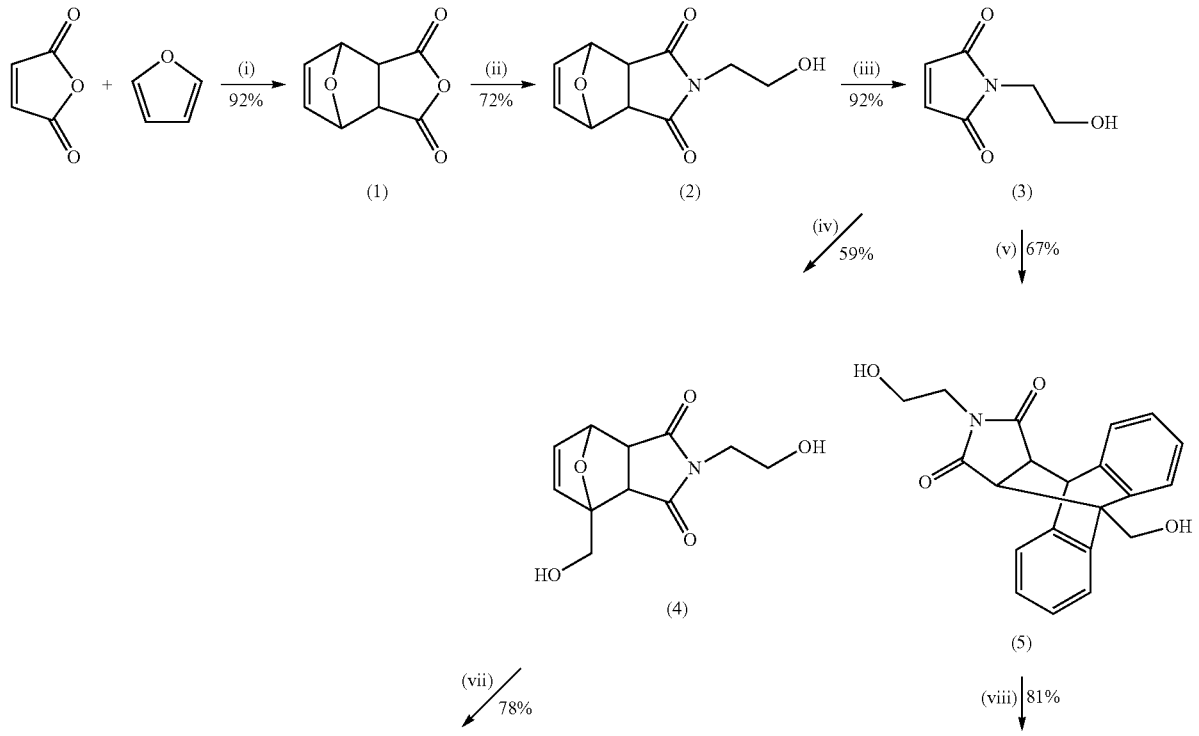

-continued

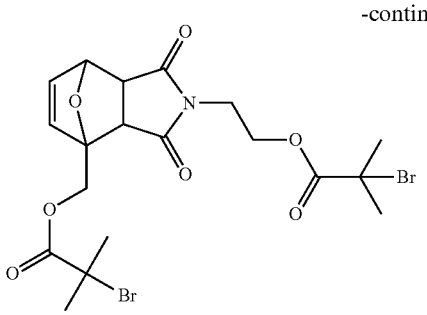

(7)

DA 1

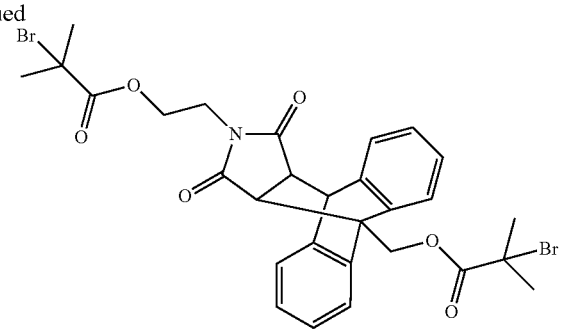

(8)

DA 2

The Diels-Alder (DA) adduct (1) is prepared by heating a suspension of maleic anhydride in furan and toluene at 120° C. for 24 h to give, after crystallization, the exo isomer. A solution of (1) in methanol and triethylamine (TEA) is treated with monoethanolamine at 0° C., and slowly heated to 67° C., affording, after crystallization, the alcohol (2) in 72% yield. This is then subjected to a retro-Diels-Alder process in refluxing toluene for 24 h, to give the maleimide containing alcohol (3), which serves as an intermediate for the synthesis of both initiators DA1 and DA2. Initiator DA1 is obtained by treatment of (3) with furfuryl alcohol to give diol (4), which is esterified with 2-bromoisobutyryl bromide in tetrahydrofuran (THF) and TEA, to give, after flash chromatography, the difunctional initiator DA1 in 78% yield. DA2 is prepared in an analogous way, by treating (3) with 9-anthracenemethanol followed by esterification of the resulting diol (5) with 2-bromoisobutyryl bromide in THF-TEA, to give DA2 in 81% yield.

Example 3

A linear poly(methyl methacrylate) (PMMA) is prepared using DA1 or DA2 as the initiator with Cu(I)Br-pyridine imine ligand as catalyst. Polymerization in non-polar/coordinating solvents is carried out at 50° C. The polymerizations proceed showing relatively linear first-order kinetic plots and linear increase of Mn with conversion, affording polymers P1-P4 of narrow molecular weight distributions as determined by GPC analysis using chloroform-TEA 95:5 as the eluent. The results are shown in the following Table 1.

In this table, PD refers to polydispersity or Mw/Mn. IV refers to intrinsic viscosity. Mp refers to peak molecular weight.

TABLE 1

| Polymer | Properties | Original | Cleaved | Reformed |
|---|---|---|---|---|
| P1 | Mn | 11900 g mol−1 | 6490 g mol−1 | 8900 g mol−1 |
| | Mw | 13400 g $mol^{-1}$ | 7470 g $mol^{-1}$ | 10800 g $mol^{-1}$ |
| | Mp | 13800 g $mol^{-1}$ | 7770 g $mol^{-1}$ | 8700 g $mol^{-1}$ |
| | PD | 1.12 | 1.21 | 1.24 |
| | IV | 0.072 | 0.041 | 0.052 |
| P2 | Mn | 5400 g $mol^{-1}$ | 2760 g $mol^{-1}$ | 4100 g $mol^{-1}$ |
| | Mw | 5650 g $mol^{-1}$ | 2840 g $mol^{-1}$ | 4130 g $mol^{-1}$ |
| | Mp | 5800 g $mol^{-1}$ | 2900 g $mol^{-1}$ | 4320 g $mol^{-1}$ |
| | PD | 1.11 | 1.18 | 1.21 |
| P3 | Mn | 54720 g $mol^{-1}$ | 28450 g $mol^{-1}$ | 41980 g $mol^{-1}$ |
| | Mw | 58680 g $mol^{-1}$ | 29990 g $mol^{-1}$ | 42800 g $mol^{-1}$ |
| | Mp | 61100 g $mol^{-1}$ | 31350 g $mol^{-1}$ | 44320 g $mol^{-1}$ |
| | PD | 1.15 | 1.22 | 1.24 |

The ability of polymers P1-P3 to respond to thermal stimuli is investigated. Following thermal treatment of polymers P1-P3 under reflux in toluene over 24 hours the polymers are evaluated for the extent of cleavage. Table 1 shows an increase in PD in all cases for cleaved polymer P1-P3 as compared to original polymer P1-P3. After removal of the solvent under reduced pressure, the reaction mixture is heated at 60° C. for 24 h and the polymers reform to show an increase in PD over the cleaved polymers.

Polymers prepared from the difunctional initiator DA1 show excellent cleavage/reforming properties. Polymer P4, prepared from the difunctional initiator DA2, (Mn 11900 g/mol, PD of 1.18) is introduced as maleimide-anthracene polymer.

Overbased Metal-Containing Detergent

The lubricant or functional fluid composition may contain one or more overbased metal-containing detergents. Overbased materials otherwise referred to as overbased or superbased salts, may be single phase, homogeneous Newtonian systems characterized by a metal content in excess of that which would be present for neutralization according to the stoichiometry of the metal and the particular acidic organic compound reacted with the metal. The overbased materials may be prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material may have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Second Edition, Edited by R. M. Mortier and S. T. Orszulik, Copyright 1997.

The metal of the overbased metal-containing detergent may be zinc, sodium, calcium, barium, magnesium, or a mixture of two or more thereof. The metal may be sodium, calcium, or magnesium The overbased metal-containing detergent may be selected from non-sulfur containing phenates, sulfur containing phenates, sulfonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g. phenate-salicylates, sulfonate-phenates, sulfonate-salicylates, sulfonates-phenates-salicylates, as described; for example, in U.S. Pat. Nos. 6,429,178; 6,429,179; 6,153,565; and 6,281,179. Where, for example, a hybrid sulfonate-phenate detergent is employed, the hybrid detergent would be considered equivalent to amounts of distinct phenate and sulfonate detergents introducing like amounts of phenate and sulfonate soaps, respectively.

The overbased metal-containing detergent may comprise zinc, sodium, calcium or magnesium salts of a phenate, sulfur containing phenate, sulfonate, salixarate or salicylate. Overbased salixarates, phenates and salicylates may have a total base number (ASTM D3896) in the range from about 180 to about 450 TBN. Overbased sulfonates may have a total base number in the range from about 250 to about 600, or in the range from about 300 to about 500. Overbased detergents are known in the art. The sulfonate detergent may be a predominantly linear alkylbenzene or alkyltoluene sulfonate detergent having a metal ratio of at least about 8 as is described in paragraphs [0026] to [0037] of U.S. Patent Publication 2005/065045. The predominantly linear alkyl group may be attached to the benzene or toluene at any location along the linear alkyl chain, such as at the 2, 3, or 4 position. The predominantly linear alkylbenzene sulfonate detergent may be useful for improving fuel economy.

The overbased metal-containing detergent may be a calcium or magnesium overbased detergent. The lubricant composition may comprise an overbased calcium sulfonate, an overbased calcium phenate, or a mixture thereof. The overbased detergent may comprise a calcium sulfonate with a metal ratio of at least about 3.5, for example, in the range from about 3.5 to about 40, or in the range from about 5 to about 25, or in the range from about 7 to about 20.

The lubricant composition may further comprise a low overbased detergent (metal ratio of equal to or less than about 3.5, for example, in the range from about 0 to about 3.5, or in the range from about 0.5 to about 3, or in the range from about 1 to about 2.5, or in the range from about 1.5 to about 2) or a neutral detergent.

The overbased metal-containing detergent may be present in the lubricant or functional fluid composition at a concentration in the range from about 0.05% by weight to about 5% by weight of the lubricant composition. The overbased detergent may be present at a concentration in the range from about 0.1%, about 0.3%, or about 0.5% up to about 3.2%, or about 1.7%, or about 0.9% by weight of the lubricant composition. Similarly, the overbased detergent may be present in an amount suitable to provide a TBN (total base number) in the range from about 1 to about 10 to the lubricant composition. The overbased detergent may be present in amount which provides a TBN in the range from about 1.5 up to about 3, or up to about 5, or up to about 7, to the lubricant composition.

Metal-containing detergents, in addition to TBN, may also provide ash to the lubricant or functional fluid composition. Sulfated ash (ASTM D874) is another parameter often used to characterize overbased detergents and lubricant compositions. The lubricant composition may have sulfated ash levels of about 0.3 to about 1.2% by weight, or from about 0.3 to about 1.0% or from about 0.5 to about 1.0%, or greater than about 0.6%. In other embodiments (e.g., for marine diesel cylinder lubricants) the ash level may be from about 1 to about 15%, or from about 2 to about 12% by weight, or from about 4 to about 10%. The overbased detergent may account for about 50% to about 100% of the sulfated ash, or at least about 70% of the ash, or at least about 80% of the ash, or 100% of the ash. The overbased detergent may provide for no more than about 95% of the sulfated ash, or no more than about 98% of the sulfated ash.

The lubricant composition may be a marine diesel cylinder lubricant (MDCL). Lubricants of this type may be characterized by high TBN levels delivered primarily by metal containing overbased detergents. In some embodiments, the lubricant composition may have a TBN of at least about 10, or at least about 20, e.g., 10-100, 20-100, 30-100, 40-80, 30-75, or 40-70. Most of the basicity of the MDCL composition may be contributed by the detergent component, although typically a relatively small amount (e.g., less than about 5%) of the TBN may be contributed by other species such as nitrogen-containing dispersants.

Other Performance Additives

The lubricant or functional fluid composition may comprise other performance additives. These may include one or more metal deactivators, supplemental viscosity modifiers, supplemental detergents, friction modifiers, antiwear agents, corrosion inhibitors, dispersants, supplemental dispersant viscosity modifiers, extreme pressure agents, antioxidants, foam inhibitors, demulsifiers, pour point depressants, seal swelling agents, mixtures of two or more thereof.

Antioxidants may include sulfurized olefins, diarylamines, alkylated diarylamines, hindered phenols, molybdenum compounds (such as molybdenum dithiocarbamates), hydroxylthioethers, or mixtures thereof. The antioxidant may be present at a concentration in the range from about 0 wt % to about 15 wt %, or about 0.1 wt % to about 10 wt %, or about 0.5 wt % to about 5 wt %, or about 0.5 wt % to about 3 wt % of the lubricant composition.

The diarylamine or alkylated diarylamine may be a phenyl alpha-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant may contain a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. The hindered phenol antioxidant may be an ester, such as the ester available under the tradename Irganox™ L-135 from Ciba. Such materials may be represented by the general formula

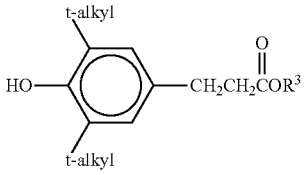

wherein $R^3$ is a hydrocarbyl group such as an alkyl group containing, e.g., 1 to about 18, or 2 to about 12, or 2 to about 8, or 2 to about 6 carbon atoms; and t-alkyl can be t-butyl. A detailed description of ester-containing hindered phenol antioxidants that may be used may be found in U.S. Pat. No. 6,559,105.

Examples of molybdenum dithiocarbamates which may be used as an antioxidant include commercial materials sold under trade names such as Vanlube 822™ and Molyvan™ A from R. T. Vanderbilt Co., Ltd., and Adeka Sakura-Lube™ S-100, S-165, S-525 and S-600 from Asahi Denka Kogyo K. K, and mixtures thereof.

The lubricant or functional fluid composition may further include one or more supplemental conventional viscosity modifiers. These may include hydrogenated styrene-butadiene rubbers, ethylene-propylene copolymers, polymethacrylates, polyacrylates, hydrogenated styrene-isoprene polymers, hydrogenated diene polymers, poly(alkyl styrenes), polyolefins, esters of maleic anhydride-olefin copolymers (such as those described in International Application WO 2010/014655), esters of maleic anhydride-styrene copolymers, or mixtures or two or more thereof.

The lubricant or functional fluid compositions may further include one or more supplemental conventional dispersant viscosity modifiers. These may include one or more functionalized polyolefins, for example, ethylene-propylene copolymers that have been functionalized with an acylating agent such as maleic anhydride and an amine; polymethacrylates functionalized with an amine; or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. The dispersant viscosity modifier may include those described in U.S. Pat. No. 4,863,623 (see column 2, line 15 to column 3, line 52) or in International Publication WO2006/015130 (see page 2, paragraph [0008] and preparative examples described in paragraphs [0065] to [0073]). The dispersant viscosity modifier may be present at a concentration of up to about 15 wt %, or up to about 10 wt %, or in the range from about 0.05 wt % to about 5 wt %, or from about 0.2 wt % to about 2 wt % of the lubricant composition. The lubricant or functional fluid composition may further include one or more dispersants. The dispersant may be a succinimide dispersant, a Mannich dispersant, a succinamide dispersant, a polyolefin succinic acid ester, amide, or ester-amide, or mixtures thereof. The dispersant may be present as a single dispersant, or it may be present as a mixture of two or more (e.g., three) different dispersants, wherein at least one may be a succinimide dispersant.

The succinimide dispersant may be derived from one or more aliphatic polyamines. The aliphatic polyamine may be an aliphatic polyamine such as ethylenepolyamine (i.e., a poly(ethyleneamine)), a propylenepolyamine, a butylenepolyamine, or a mixture of two or more thereof. The aliphatic polyamine may be ethylenepolyamine. The aliphatic polyamine may be selected from ethylenediamine, diethylenetriamine, triethylenetetramine, tetraethylenepentamine, pentaethylenehexamine, polyamine still bottoms, or a mixture of two or more thereof.

The succinimide dispersant may be derived from an aromatic amine, aromatic polyamine, or mixture thereof. The aromatic amine may have one or more aromatic moieties linked by a hydrocarbylene group and/or a heteroatom such as 4-amino diphenylamine. The aromatic amine may be a nitro-substituted aromatic amine. Examples of nitro-substituted aromatic amines may include 2-nitroaniline, 3-nitroaniline, and 4-nitroaniline. 3-nitroaniline may be particularly useful. Other aromatic amines may be present along with the nitroaniline. Condensation products with nitroaniline and optionally also with Disperse Orange 3 (that is, 4-(4-nitrophenylazo)aniline) are disclosed in U.S. Patent Publication 2006/0025316.

The dispersant may comprise a polymer functionalized with an amine, e.g., a succinimide dispersant. The amine may be an amine having at least 2, or at least 3, or at least 4 aromatic groups, for instance, from about 4 to about 10, or from about 4 to about 8, or from about 4 to about 6 aromatic groups, and at least one primary or secondary amino group or, alternatively, at least one secondary amino group. The amine may comprise both a primary and at least one secondary amino group. The amine may comprise at least about 4 aromatic groups and at least 2 secondary or tertiary amino groups.

An example of an amine having 2 aromatic groups is N-phenyl-p-phenylenediamine. An example of an amine having at least 3 or 4 aromatic groups may be represented by Formula (I):

Formula 1

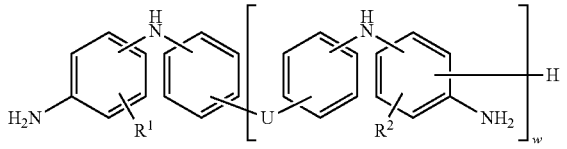

wherein, independently, each variable is as follows: $R^1$ may be hydrogen or a $C_{1-5}$ alkyl group (typically hydrogen); $R^2$ may be hydrogen or a $C_{1-5}$ alkyl group (typically hydrogen); U may be an aliphatic, alicyclic or aromatic group (when U is aliphatic, the aliphatic group may be a linear or branched alkylene group containing 1 to about 5, or 1 to about 2 carbon atoms); and w may be from 1 to about 10, or 1 to about 4, or 1 to 2 (typically 1). When U is an aliphatic group, U may be an alkylene group containing 1 to about 5 carbon atoms. Alternatively, the amine may also be represented by Formula (1a)

Formula (1a)

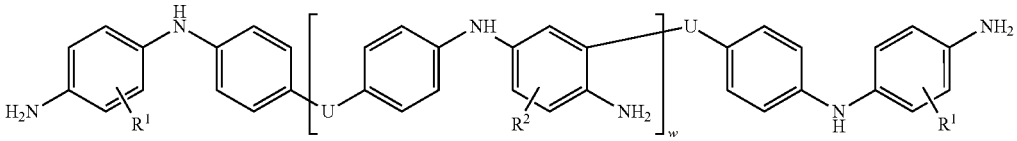

wherein each variable U, $R^1$, and $R^2$ are the same as described above and w is 0 to about 9, or 0 to about 3, or 0 to about 1 (typically 0).

The dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a polyamine, typically diethylenetriamine, polyamine still bottoms, tetraethylenepentamine (TEPA), and the like).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of from about 350 to about 5000, or from about 550 to about 3000 or from about 750 to about 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. The post-treated dispersant may be borated. The post-treated dispersant may result from a reaction of the dispersant with a dimercaptothiadiazole. The post-treated dispersant may result from a reaction of the dispersant with phosphoric or phosphorous acid.

The dispersant may be present in the lubricant or functional fluid composition at a concentration in the range from about 0.01 wt % to about 20 wt %, or from about 0.1 wt % to about 15 wt %, or from about 0.1 wt % to about 10 wt %, or from about 1 wt % to about 6 wt %, or from about 1 to about 3 wt % of the lubricating composition.

The friction modifier may be selected from long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. As used herein the term "fatty alkyl or fatty" in relation to friction modifiers means a carbon chain having from about 10 to about 22 carbon atoms, typically a straight carbon chain. Alternatively, mono-branched alkyl groups may be used in place of the fatty alkyl groups. Typical mono-branched alkyl groups may include beta-branched groups such as 2-ethylhexyl, 2-propylheptyl, and the like. The friction modifier may be present in the lubricant composition at a concentration in the range from 0 wt % to about 6 wt %, or about 0.01 wt % to about 4 wt %, or from about 0.05 wt % to about 2 wt %, or from about 0.1 wt % to about 2 wt % of the lubricant composition.

Examples of friction modifiers that may be used may include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, molybdenum dialkyldithiophosphates, molybdenum dithiocarbamates, and monoesters of a polyol and an aliphatic carboxylic acid derived or derivable from sunflower oil or soybean oil.

The friction modifier may be a long chain fatty acid ester. The long chain fatty acid ester may be a mono-ester, diester, (tri)glyceride, or a mixture of two or more thereof.

The lubricant or functional fluid composition may optionally further include at least one antiwear agent. Examples of suitable antiwear agents may include tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis (S-alkyldithiocarbamyl) disulphides. The antiwear agent may, in one embodiment, include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least about 8.

Another class of additives may include oil-soluble titanium compounds such as disclosed in U.S. Pat. No. 7,727,943 and U.S. Patent Publication 2006/0014651. These may function as antiwear agents, friction modifiers, antioxidants, deposit control additives, and the like. These additives may be multifunctional additives. For example, one of these additives may provide both antiwear and antioxidant properties. The oil soluble titanium compound may be a titanium (IV) alkoxide. The titanium alkoxide may be formed from a monohydric alcohol, a polyol or mixtures thereof. The monohydric alkoxides may contain from 2 to about 16 carbon atoms, or from 3 to about 10 carbon atoms. The titanium alkoxide may be titanium (IV) isopropoxide. The titanium alkoxide may be titanium (IV) 2-ethylhexoxide. The titanium compound may comprise the alkoxide of a vicinal 1,2-diol or polyol. The 1,2-vicinal diol may comprise a fatty acid mono-ester of glycerol, such as oleic acid.

The oil soluble titanium compound may be a titanium carboxylate. The titanium carboxylate may be derived from a titanium alkoxide and a carboxylic acid selected from the group consisting of a non-linear mono-carboxylic acid and a carboxylic acid having more than about 22 up to about 25 carbon atoms. Examples of titanium/carboxylic acid products may include titanium reaction products with acids selected from the group comprising caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466.

Extreme Pressure (EP) agents that are soluble in the oil may include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents may include chlorinated wax; sulfurized olefins (such as sulfurized isobutylene), a hydrocarbyl-substituted 2,5-dimercapto-1,3,4-thiadiazole, or oligomers thereof, organic sulphides and polysulphides such as dibenzyldisulphide, bis-(chlorobenzyl)disulphide, dibutyl tetrasulphide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405).

Foam inhibitors that may be used in the lubricant composition may include polysiloxanes, copolymers of ethyl acrylate and 2-ethylhexylacrylate, and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be used in the lubricant composition may include polyalphaolefins, esters of maleic anhydride-styrene copolymers, poly(meth)acrylates, polyacrylates or polyacrylamides.

Demulsifiers that may be used may include trialkyl phosphates, and various polymers and copolymers of ethylene glycol, ethylene oxide, propylene oxide, or mixtures of two or more thereof.

Metal deactivators may include derivatives of benzotriazoles (typically tolyltriazole), 1,2,4-triazoles, benzimidazoles, 2-alkyldithiobenzimidazoles or 2-alkyldithio-benzothiazoles. The metal deactivators may also be described as corrosion inhibitors.

Seal swell agents that may be used may include sulfolene derivatives such as Exxon Necton-37™ (FN 1380) and Exxon Mineral Seal Oil™ (FN 3200).

The lubricant or functional fluid composition may include at least one phosphorus acid, phosphorus acid salt, phosphorus acid ester or derivative thereof including sulfur-containing analogs. The phosphorus acids, salts, esters or derivatives thereof may include phosphoric acid, phosphorous acid, phosphorus acid esters or salts thereof, phosphoric acid esters or salts thereof, phosphorous acid esters or salts thereof, phosphites, phosphorus-containing amides, phosphorus-containing carboxylic acids or esters, phosphorus-containing ethers, and mixtures of two or more thereof. Phosphorus acid anhydrides may be used. The phosphorus acid, ester or derivative may be an organic or inorganic phosphorus acid, phosphorus acid ester, phosphorus acid salt, or derivative thereof. The phosphorus acids may include the phosphoric, phosphonic, phosphinic, and thiophosphoric acids including dithiophosphoric acid as well as the monothiophosphoric, thiophosphinic and thiophosphonic acids. One group of phosphorus compounds that may be used are alkylphosphoric acid mono alkyl primary amine salts as represented by the formula

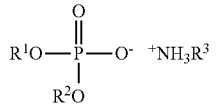

where $R^1$, $R^2$, $R^3$ are alkyl or hydrocarbyl groups or one of $R^1$ and $R^2$ can be H. A 1:1 mixture of dialkyl and monoalkyl phosphoric acid esters may be used. An additional amount of amine may be added to further salt the monoalkyl diacid. Compounds of this type are described in U.S. Pat. No. 5,354,484. Eighty-five percent (85%) phosphoric acid (which contains 15% by weight water) may be used. These may be used as phosphorus adjustment agents. The phosphorus adjustment agent may be added to the lubricant or functional fluid at a concentration in the range from about 0.01 to about 3% by weight based on the weight of the lubricant or functional fluid, and in one embodiment from about 0.03% to about 0.2%, or from about 0.03% to about 0.1% by weight.

INDUSTRIAL APPLICATION

The lubricant or functional fluid composition may be an engine oil, an automatic transmission fluid (ATF), traction fluid, fluid for a continuously variable transmission (CVT), dual clutch automatic transmission fluid, farm tractor fluid, manual transmission fluid, fluids for a hybrid vehicle transmission, gear oil, engine lubricant, hydraulic fluid, and the like. The lubricant or functional fluid composition may be used to lubricate a mechanical device, by supplying the lubricant as described herein to the device. The device may be a transmission, as listed above, a gearbox, a farm tractor, or a hydraulic device. The device may also be an internal combustion engine such as a gasoline-fired or diesel-fired automobile engine, a heavy duty diesel engine, a marine diesel engine, or a stationary gas engine. Such engines may be sump lubricated, and the lubricant may be provided to the sump from whence it may lubricate the moving parts of the engine. Alternatively, the lubricant may be supplied from a separate source, not a part of a sump.

The internal combustion engine may be a diesel fueled engine (typically a heavy duty diesel engine), a gasoline fueled engine, a natural gas fueled engine, a mixed gasoline/alcohol fueled engine, or a hydrogen fueled internal combustion engine. The internal combustion engine may be a diesel fueled engine or a gasoline fueled engine. The internal combustion engine may be a heavy duty diesel engine.

The internal combustion engine may be a 2-stroke or 4-stroke engine. Suitable internal combustion engines may include marine diesel engines (which may comprise a cylinder which is lubricated with said lubricant), aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

One class of internal combustion engines is direct injected combustion engines wherein the fuel is injected directly into the cylinder. Specific examples of direct injection may include wall guided and spray guided direct injection engines. The lubricant composition may be used to lubricate a gasoline direct injection engine.

The lubricant composition may be suitable for use as any engine lubricant irrespective of the sulfur, phosphorus or sulfated ash content. The sulfur content of the lubricant composition when used as an engine oil may be about 1 wt % or less, or about 0.8 wt % or less, or about 0.5 wt % or less, or about 0.3 wt % or less. The sulfur content may be in the range of about 0.001 wt % to about 0.5 wt %, or about 0.01 wt % to about 0.3 wt %. The phosphorus content may be about 0.2 wt % or less, or about 0.12 wt % or less, or about 0.1 wt % or less, or about 0.085 wt % or less, or about 0.08 wt % or less, or about 0.06 wt % or less, or about 0.055 wt % or less, or about 0.05 wt % or less. The phosphorus content may be from about 0.04 wt % to about 0.12 wt %. The phosphorus content may be from about 100 ppm to about 1000 ppm, or about 200 ppm to about 600 ppm. The total sulfated ash content may be about 0.3 wt % to 1.2 wt %, or about 0.5 wt % to about 1.1 wt % of the lubricant composition. The sulfated ash content may be about 0.5 wt % to 1.1 wt % of the lubricant composition. The lubricant composition may be characterized by a chlorine content of up to about 100 ppm, or up to about 50 ppm, or up to about 10 ppm.

The lubricant composition may be an engine oil, wherein the lubricant composition may be characterized as having at least one of (i) a sulfur content of about 0.5 wt % or less, (ii) a phosphorus content of about 0.12 wt % or less, and (iii) a sulfated ash content of about 0.5 wt % to about 1.1 wt % of the lubricant composition.

The lubricant composition may be a marine diesel cylinder lubricant, which may be used to lubricate a marine diesel cylinder. The marine diesel cylinder may be in a 2-stroke marine diesel engine. Marine diesel cylinder lubricants are typically used for one pass and are consumed, rather than being retained in a sump. These lubricants may require a high detergent level, imparting high levels of basicity as measured by TBN to the lubricant, typically resulting in TBN levels of about 20 or greater, such as about 30 or greater, or about 40 or greater, or about 50 or greater, or about 70 or greater, and typically up to about 80, or up to about 100, or up to about 300.

Typical lubricants for hydraulic devices, comprising the polymer of the present technology, may, in certain embodiments, have formulations in the general ranges shown below. (In these tables, the amounts and alternative amounts of various components may be combined.)

| Component | Amounts, % | Alternative amounts, % | Alternative amounts, % |
|---|---|---|---|
| Disclosed polymer | 2-18 | 4-15 | 5-12 |
| Zinc dialkyldithiophosphate(s) | 0.0-1.5 | 0.3-1.2 | 0.4-0.9 |
| Detergent(s) (neutral and/or overbased) | 0.0-0.30 | 0.03-0.25 | 0.05-0.18 |
| Antioxidant(s) | 0.0-3 | 0.10-1.5 | 0.15-1.2 |
| Antifoam agent(s) | 0-0.015 | 0.001-0.008 | 0.001-0.003 |
| Corrosion inhibitor(s) | 0-0.5 | 0.001-0.02 | 0.006-0.08 |
| Other additive(s) | 0-10 | 0.01-4 | 0.03-1.5 |
| Oil (including diluent oils) | balance | balance | balance |

The following are two examples of hydraulic fluids containing the polymer of the present technology:

| Component, Amount, % | Ex. 1 | Ex. 2 |
|---|---|---|
| Disclosed polymer | 6 | 10 |
| Zinc dialkyldithiophosphate | 0.44 | 0.82 |
| Overbased calcium phenate | 0.02 | 0.09 |
| Neutral calcium sulfonate | 0.04 | 0.07 |
| Phenolic antioxidant | 0.18 | 0.50 |
| Amine antioxidant | | 0.50 |
| Ester copolymer antifoam agent | 0.002 | |
| Substituted triazole corrosion inhibitors | 0.07 | 0.06 |

-continued

| Component, Amount, % | Ex. 1 | Ex. 2 |
|---|---|---|
| Hydrocarbyl-substituted succinic anhydride | 0.035 | |
| Hydrocarbyl succinate ester | | 0.56 |
| Polyether | 0.008 | |
| Heterocyclic ether | | 0.05 |
| Oil (including diluent oils) | balance | balance |

Typical lubricants for manual transmissions, comprising the polymer of the present technology, may, in certain embodiments, have formulations in the general ranges shown:

| Component | Amounts, % | Alternative amounts, % | Alternative amounts, % |
|---|---|---|---|
| Disclosed polymer | 2-35 | 5-30 | 10-25 |
| Zinc dialkyldithiophosphate(s) | 0-2 | 0.1-1.5 | 0.8-1.2 |
| Overbased detergent(s) | 0-3 | 0.1-2 | 0.3-1.5 |
| Antioxidant(s) | 0-3 | 0.10-2.0 | 0.6-1.0 |
| Dispersant(s) | 0-2 | 0.01-1.0 | 0.35-0.4 |
| Pour point depressants) | 0-0.2 | 0.005-0.05 | 0.01-0.018 |
| Phosphorus ester(s) | 0-2 | 0.1-1 | 0.6-0.8 |
| Other additive(s) | 0-10 | 0.1-4 | 0.6-1.8 |
| Oil (including diluent oils) | balance | balance | balance |

The following are two examples of manual transmission fluids containing the polymer of the present technology:

| Component, Amount, % | Ex. 3 | Ex. 4 |
|---|---|---|
| Disclosed polymer | 24 | 10.2 |
| Zinc dialkyldithiophosphate | 1.06 | |
| Overbased magnesium sulfonate | 1.2 | |
| Overbased calcium sulfonate | | 0.367 |
| Antioxidant | | 0.75 |
| Succinimide dispersant | | 0.370 |
| Pour point depressant | 0.011 | 0.015 |
| Phosphorus esters and/or amine salts | 0.75 | 0.67 |
| Antifoam agent | 0.02 | 0.02 |
| Alkenyl ester sulfide | 1.0 | |
| Alkenyl amide | 0.25 | |
| Seal swell agent | 0.30 | |
| Dimercaptothiadiazole ("DMTD") | | 0.45 |
| Ethoxylated octylphenol/alkylphenyl ether | | 0.25 |
| Oil (including diluent oils) | balance | balance |

Typical lubricants for automatic transmissions, comprising the polymer of the present technology, may, in certain embodiments, have formulations in the general ranges shown:

| Component | Amounts, % | Alternative amounts, % | Alternative amounts, % |
|---|---|---|---|
| Disclosed polymer | 0.5-10 | 1-5 | 2-3 |
| Dispersant(s), optionally functionalized with boron or DMTD | 0-8 | 1-5 | 2-4 |
| Antioxidant(s) | 0-3 | 0.2-2 | 0.8-1.2 |
| Detergent(s), overbased or neutral | 0-3 | 0.05-1 | 0.15-0.3 |
| Corrosion inhibitors | 0-0.5 | 0.05-0.18 | 0.08-0.12 |
| Inorganic phosphorus acid | 0-0.5 | 0.01-0.02 | 0.09-0.12 |
| Viscosity modifier | 0-7 | 1-4 | 2-3 |
| Other additive(s) | 0-10 | 0.5-8 | 2-6 |
| Oil (including diluent oils) | balance | balance | balance |

The following is an example of an automatic transmission fluid containing the polymer of the present technology:

| Component, Amount, % | Ex. 5 |
|---|---|
| Disclosed polymer | 2.5 |
| Borated succinimide dispersant and succinimide dispersant functionalized with boron and DMTD | 3.0 |
| Aminic antioxidant and sulfur-based antioxidant | 1.0 |
| Overbased sulfonate detergent | 0.075 |
| Neutral sulfonate detergent | 0.15 |
| Substituted thiadiazole and triazole corrosion inhibitors | 0.095 |
| Phosphoric acid (85%, aqueous) | 0.11 |
| Polymeric viscosity modifier | 2.3 |
| Alkyl phosphite antiwear agent | 0.20 |
| Alkyl borate ester | 0.75 |
| Ethoxylated tallowamine | 0.035 |
| Alkyl and alkenyl imidazolines | 0.18 |
| Alkenyl phosphite | 0.08 |
| Alkyl acetamide | 0.75 |
| Long chain hydroxyalkylamine | 0.28 |
| Seal swell agent | 1.1 |
| Pourpoint depressant | 0.10 |
| Antifoam agents | 0.07 |

While the invention has been explained in relation to various embodiments, it is to be understood that various modifications thereof may become apparent to those skilled in the art upon reading this specification. Therefore, it is to be understood that the invention includes all such modifications that may fall within the scope of the appended claims.

The invention claimed is:

1. A method of restoring viscosity or viscosity index to a lubricating composition that has degraded during operation of a mechanical device, comprising including within said lubricating composition a viscosity improving amount of about 0.5 to about 20 weight percent of a self-healing polymer consisting of a poly(meth)acrylate which comprises from about 50 to about 90 weight percent monomer units derived from $C_{12}$ to $C_{18}$ alkyl (meth)acrylate monomer units and one or more linkages comprising one or more disulfide bonds which permit the polymer to reform if cleaved during use.

2. The method of claim 1 wherein the poly(meth)acrylate comprises from about 50 to about 90 weight percent monomer units derived from $C_{12}$ to $C_{15}$ alkyl (meth)acrylate monomer units and one or more linkages comprising one or more disulfide bonds which permit the polymer to reform if cleaved during use.

3. The method of claim 1 wherein the poly(meth)acrylate further comprises a nitrogen-containing monomer.

4. The method of claim 1 wherein the self-healing polymer comprises a star polymer with a core and a disulfide bond located at the core.

5. The method of claim 1 wherein the self-healing polymer comprises a backbone containing one or more disulfide bonds.

6. The method of claim 1 wherein the self-healing polymer comprises a branched polymer with a backbone and one or more branches which themselves are branched; and containing one or more disulfide bonds in the backbone, in one or more branches, or at one or more branching points.

7. The method of claim 1 wherein the lubricating composition further comprises an overbased metal-containing detergent.

8. The method of claim 1 wherein the lubricating composition further comprises a dispersant.

9. The method of claim 1 wherein the lubricating composition further comprises an antiwear agent.

10. The method of claim 1 wherein the lubricating composition further comprises an antioxidant.

11. The method of claim 1 wherein the lubricating composition further comprises a friction modifier.

12. The method of claim 1 wherein the lubricating composition further comprises a pour point dispersant.

13. The method of claim 1 wherein the lubricating composition further comprises an anti-foam agent.

14. The method of claim 1 wherein the lubricating composition further comprises one or more of phosphorus acids, phosphorus acid salts, phosphorus acid esters, derivative of one or more thereof, or a mixture of two or more thereof.

15. The method of claim 1 wherein the lubricating composition further comprises one or more metal deactivators, supplemental viscosity modifiers, supplemental detergents, corrosion inhibitors, supplemental dispersant viscosity modifiers, extreme pressure agents, demulsifiers, seal swelling agents, or a mixture of two or more thereof.

16. The method of claim 1 wherein the lubricating composition is an engine oil, an automatic transmission fluid, a traction fluid, a continuously variable transmission fluid, a dual clutch automatic transmission fluid, a farm tractor fluid, a manual transmission fluid, a fluid for hybrid vehicle transmissions, or a gear oil.

17. The method of claim 1 wherein the mechanical device comprises an automatic transmission, a continuously variable transmission, a dual clutch automatic transmission, a farm tractor, a manual transmission, a hybrid vehicle transmission, or a gear.

* * * * *